US009249974B2

(12) United States Patent
Zuck et al.

(10) Patent No.: US 9,249,974 B2
(45) Date of Patent: Feb. 2, 2016

(54) GAS CONVENIENCE OUTLET

(75) Inventors: James C. Zuck, Marshall, MI (US); Franco J. Domingo, Marshall, MI (US); Malia M. Bucher, Battle Creek, MI (US)

(73) Assignee: Marshall Excelsior Company, Marshall, MI (US)

( * ) Notice: Subject to any disclaimer, the term of this patent is extended or adjusted under 35 U.S.C. 154(b) by 732 days.

(21) Appl. No.: 13/047,376

(22) Filed: Mar. 14, 2011

(65) Prior Publication Data

US 2011/0308633 A1 Dec. 22, 2011

Related U.S. Application Data

(63) Continuation of application No. 11/754,186, filed on May 25, 2007, now abandoned.

(60) Provisional application No. 60/808,261, filed on May 25, 2006.

(51) Int. Cl.
*F23K 5/00* (2006.01)

(52) U.S. Cl.
CPC ..... *F23K 5/007* (2013.01); *F23K 2401/20* (2013.01); *F23K 2900/05001* (2013.01); *Y10T 137/0402* (2015.04); *Y10T 137/698* (2015.04)

(58) Field of Classification Search
CPC ..... F23K 5/007; F23K 2401/20; F23K 2900/05001
USPC ..... 137/236.1, 356, 357, 360, 361, 505.12, 137/883; 48/191
See application file for complete search history.

(56) References Cited

U.S. PATENT DOCUMENTS

| | | | | |
|---|---|---|---|---|
| 1,892,776 | A * | 1/1933 | Heil et al | 137/606 |
| 2,236,104 | A * | 3/1941 | Mcintosh | 137/361 |
| 3,075,546 | A * | 1/1963 | Roberts et al. | 137/505.25 |
| 3,176,710 | A * | 4/1965 | Eichelman | 137/383 |
| 3,331,392 | A * | 7/1967 | Davidson et al. | 137/559 |
| 3,474,810 | A * | 10/1969 | Welsh | 137/75 |
| 4,478,246 | A * | 10/1984 | Sherrod | 137/557 |
| 4,997,459 | A * | 3/1991 | Pelkey | 48/191 |
| 5,868,154 | A * | 2/1999 | Jones | 137/202 |
| 6,695,001 | B2 * | 2/2004 | Dicosola | 137/360 |
| 6,895,952 | B1 * | 5/2005 | Bachelder | 126/25 R |

* cited by examiner

*Primary Examiner* — Kevin Murphy
(74) *Attorney, Agent, or Firm* — Oppenhuizen Law PLC; David L. Oppenhuizen

(57) ABSTRACT

A gas convenience outlet is provided for connecting an outdoor grill or other outdoor gas fired appliance to a home gas supply or other fixed position source of fuel gas, such as natural gas or liquid petroleum gas. The outlet includes a case having an open interior and an openable cover with a manifold mounted in the interior. The manifold has an inlet operatively connected with the supply of fuel gas and has one or more outlets. A primary manual shutoff valve located in the interior of the case is operatively connected with the manifold outlet. The outlet includes an outlet connector extending outside the case. The connector has a standardized fitting that releasably couples in gas tight engagement with one or more gas fired appliances by means of standardized appliance connectors, without the need for adaptors and without a loss of performance due to restriction of the gas supply.

11 Claims, 7 Drawing Sheets

GAS CONVENIENCE OUTLET

CROSS REFERENCE TO RELATED APPLICATIONS

This application is a continuation of Applicant's co-pending U.S. patent application Ser. No. 11/754,186, filed May 25, 2007, which claims the benefit and filing priority of U.S. Provisional Application Ser. No. 60/808,261, filed May 25, 2006, both of which are incorporated herein by reference.

BACKGROUND OF THE INVENTION

The invention relates to supplying fuel to gas fueled appliances, which commonly burn natural gas (NG) or propane gas (LP), for example. More specifically, the invention relates to a gas convenience outlet for connecting a grill and other portable gas appliances to a home gas supply or other substantially stationary supply of fuel gas.

One having ordinary skill in the art, the average homeowner, and others know that valves and couplings for portable propane gas canisters and tanks are regulated and standardized. This regulation is observable in the commonly known backyard gas grill, which typically is fueled with propane gas from a refillable, twenty pound tank that is now provided with what is commonly known as a Type-1 or QCC-1 valve.

While this common fuel source of a refillable tank provides portability to the appliances with which it is connected, the appliances are typically parked at a designated location in a user's back yard or on a user's patio. Thus, the beneficial aspect of the fuel source being portable is not important when the appliance is used as a stationary device, and not as a portable device. Further, typical fuel tanks are limited in capacity. Thus, a user may prefer to have at least two tanks, so a full, backup tank is available in case a tank empties while in use. Even with a back up tank, reliance upon a compact tank-based fuel supply requires some level of user discipline to refill emptied tanks Emptying a tank in use and finding that the back up tank is also empty is not an unusual occurrence.

A stationary, bulk supply of fuel gas for household use, such as a 500 gallon tank of liquefied petroleum gas (LPG, which includes propane) typically is pressurized to about 50 to 200 pounds per square inch (psi) and includes a pressure regulator that reduces that pressure to about 10 psi. Bulk gas tanks are generally located outside of a house. At the house, another regulator reduces the gas pressure to about ½ psi before the gas is routed to the furnace or other indoor appliance. Prior gas outlet fixtures that used home heating gas for outdoor gas appliances, such as outdoor gas grills, were designed to operate on low pressure gas and therefore had to tap into the line inside the house, where the pressure has already been reduced to ½ psi. The gas line would then have to be routed outside of the house through an opening in the side or foundation of the house, and the gas line would then terminate in a special outlet fitting that is not compatible with the traditional fitting of a gas grill. A traditional gas grill also includes a pressure regulator that is designed to reduce the pressure from a twenty pound portable gas tank to ½ psi. Thus, the gas grill operator desiring to utilize an LPG supply with a prior gas outlet product, using LPG already at ½ psi, would first have to remove the pressure-reducing regulator from the gas grill. The pressure in the house gas line, to which the gas outlet box is connected, had already been reduced to ½ psi. A second inline pressure regulator would unnecessarily restrict the flow of gas, producing inconsistent results and undesirable performance, especially for high performance gas grills that require higher volume of gas. In addition, the gas grill operator had to change the conventional gas grill fitting to make it compatible with the gas outlet box. Prior options available to consumers were therefore inconvenient, inefficient, and cumbersome.

Thus, a need for a convenient connection of a gas fueled appliance with a stationary supply of fuel gas may be readily understood.

BRIEF SUMMARY OF THE INVENTION

Accordingly, a gas convenience outlet of the invention provides a safe and attractive connection with a stationary or bulk supply of fuel gas. The gas convenience outlet of the invention also eliminates the problems associated with the additional inline regulators associated with prior art gas outlet boxes as well as the onus on the consumer to change the gas grill fitting so that it is compatible with the gas outlet box.

The gas convenience outlet may have a back panel, which may have provision to mount the outlet to a desired fixed structure. A perimeter sidewall may circumscribe the back panel and extend generally perpendicularly from the back panel to a terminal edge. The sidewall may also define an interior that is bounded by the perimeter sidewall and the back panel. A front panel may be adapted to conceal the interior in a closed position and to reveal the interior in an open position. A manifold may be operatively connected with a supply of fuel gas and extend to one or more outlets, each having a separate manual shutoff valve, located in the interior and operatively connected with the manifold. A standardized appliance connection of the type provided on conventional propane tanks is located outside the interior, operatively connected with the valve, and adapted to releasably couple in gas tight engagement with a conventional connector or end fitting mounted on the end of the supply hose or pressure regulator of a gas grill or other gas fired appliance.

In one aspect of the invention, the back panel, the sidewall, and the front panel may be components of a case. In another aspect of the invention, the valve and appliance connection combine as components of a qualified valve under applicable code and regulation.

These and other features, objectives, and benefits of the invention will be recognized by one having ordinary skill in the art and by those who practice the invention, from this disclosure, including the specification, the claims, and the drawing figures.

DETAILED DESCRIPTION

Figure 1:
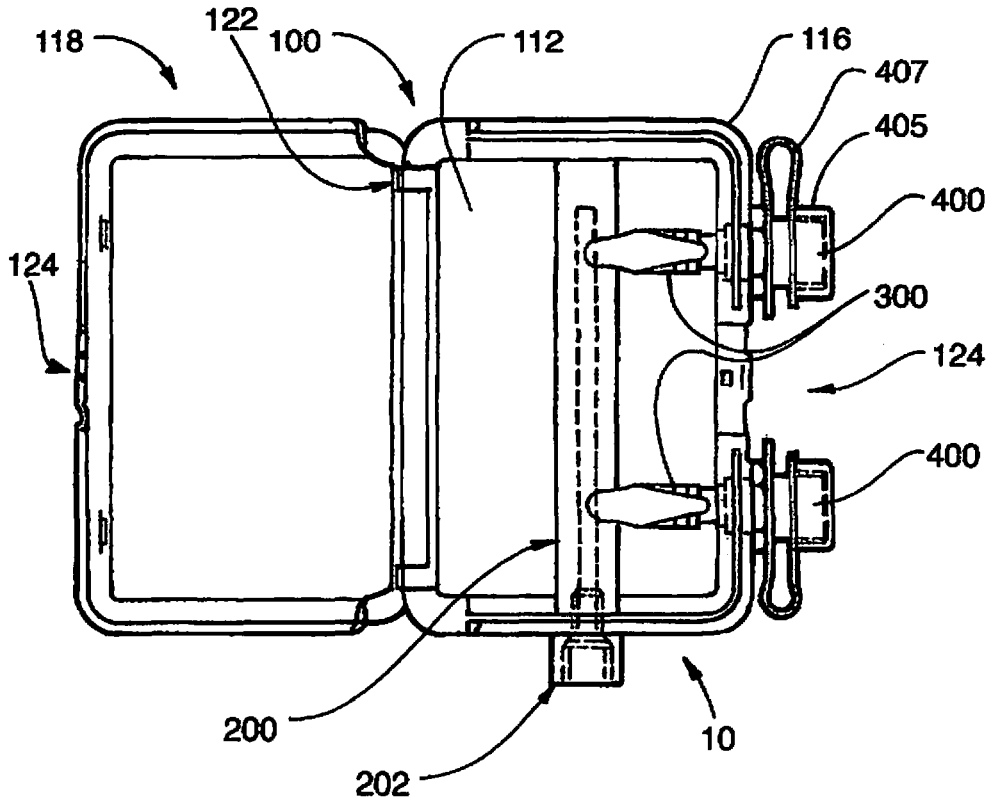
FIG. 1 is a front elevation of a duplex gas convenience outlet of the invention, showing a case with an open case door.

A preferred embodiment of a gas convenience outlet 10 according to the invention is generally shown in the drawing figures and discussed below. In the examples shown, a gas convenience outlet 10 at least includes a case 100, a manifold 200, at least one manual shutoff valve 300, and at least one appliance connection 400. For exemplary purposes, outlet 10 is shown in FIG. 9 mounted on the exterior of a building 11, connected to a gas grill 13 or other gas fired appliance.

The case 100 provides a convenient mounting for the convenience outlet, as well as an attractive enclosure, although most preferably a well ventilated and non-gas tight enclosure. Thus, the case 100 is provided with a back panel 112, which may be provided with mounting holes 114 for screw mounting of the case to a pre-selected structure, for example. The back panel has a perimeter edge and a perimeter sidewall 116 circumscribes the back panel. The sidewall extends generally perpendicularly from the back panel to a terminal edge. The perimeter sidewall and back panel define an interior of the case 100. A front panel or cover 118 may also be provided that is connected with the sidewall and adapted to conceal the interior in a closed position and to reveal the interior in an open position. Thus, the front panel may be hingedly connected with the sidewall by a hinge 122. Further, the front panel case may be provided with a latch 124 that latches the front panel or cover in the closed position.

Optionally, the hinge may be provided as a forced movement hinge, rather than a free hinge, so that the hinge holds the front panel in any position selected between the open and closed positions. The case and its components may be constructed of various structural materials, may be fabricated by various methods appropriate to the material selection, and may be designed with various configurations as desired for aesthetic, ergonomic, and structural considerations. Further, while the case 100 may also have various dimensions, an about 8.5.times.6.0.times.3.0 inch case has been found to be sufficiently large to provide single and duplex gas convenience outlets (FIGS. 1 and 2, respectfully) without unnecessary bulk or excess volume.

Figure 6:
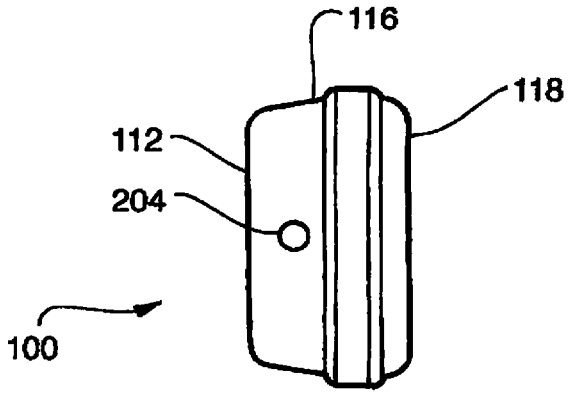
FIG. 6 is an inlet end elevation thereof.
Figure 7:
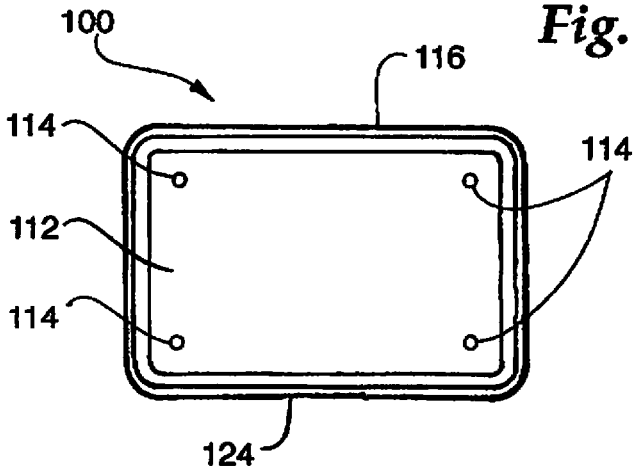
FIG. 7 is back elevation thereof.
Figure 8:
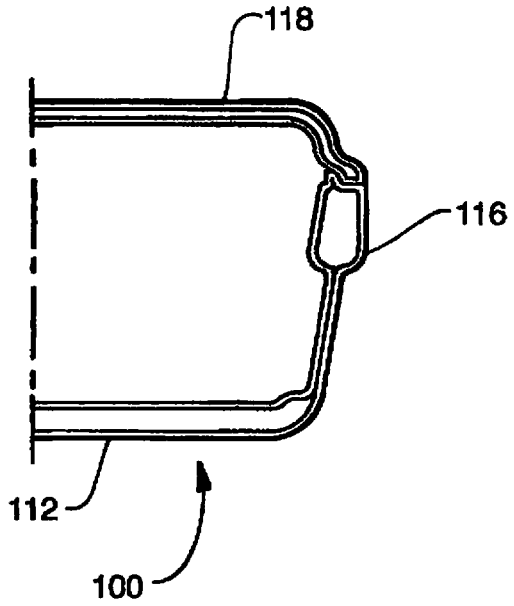
FIG. 8 is a fragmentary cross section thereof, along line VIII-VIII of FIG. 4.
Figure 9:
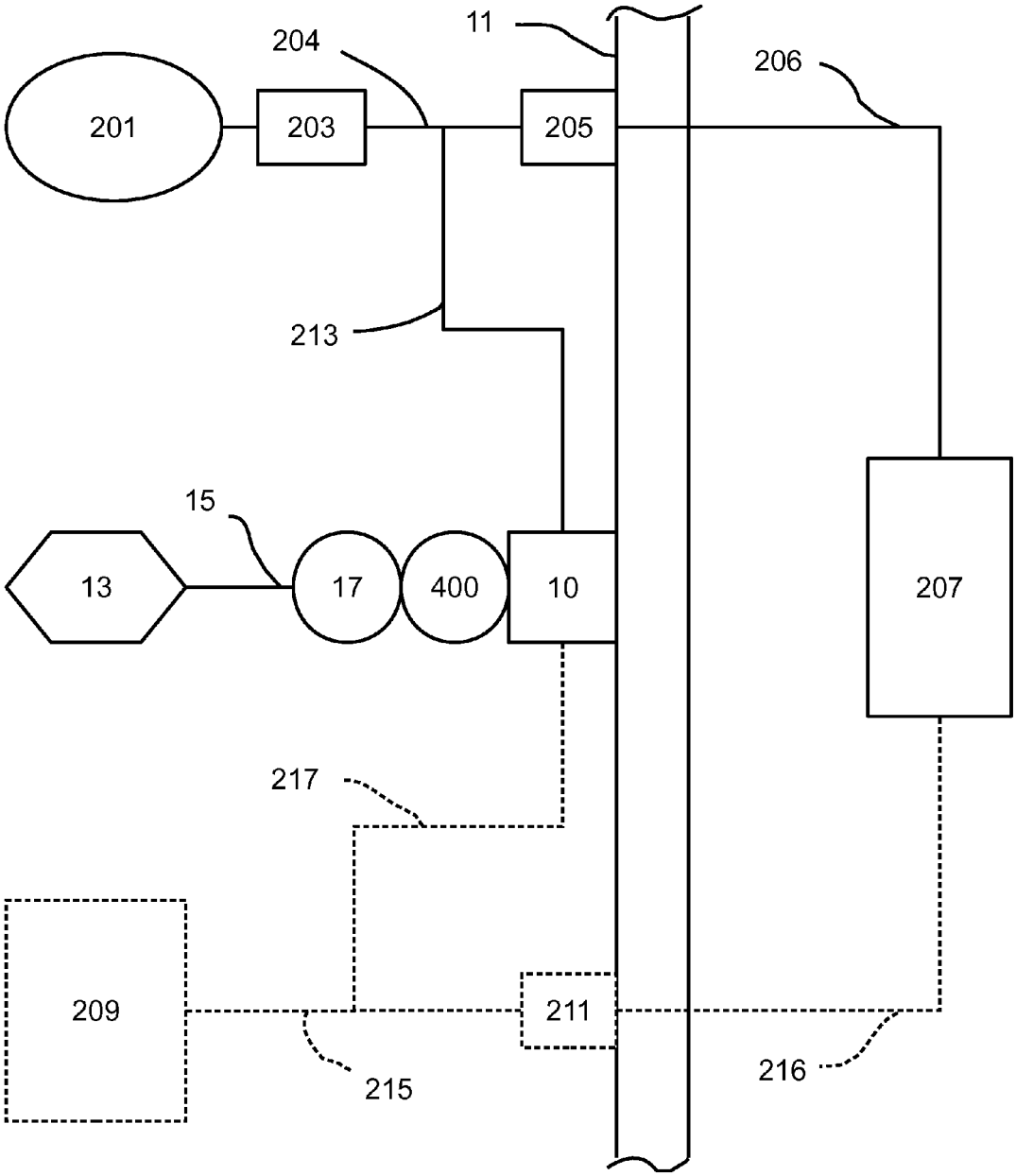
FIG. 9 is a schematic diagram showing the manner in which the convenience outlet can be connected to a household LP gas or natural gas supply, the natural gas connection being shown in phantom.

The manifold 200 is located in the interior of the case 100 and is operatively connected with a bulk supply of fuel gas, such as LPG bulk storage tank 201 (FIG. 9). One having ordinary skill in the art understands that the manifold may be constructed of various materials that are suitable for a fuel gas conduit, may be fabricated by various methods appropriate to the material selection, and may be designed with various configurations as desired for aesthetic, ergonomic, structural, and use considerations. The bulk supply of fuel gas will typically be provided as a municipal natural gas line 209 or a large, stationary liquid petroleum gas (LPG) tank 201, each as is commonly known. Of course, other gas fuel bulk supplies may be used according to specific circumstances. A ½ inch (12.7 mm) female national pipe thread (FNPT) connection 202 is anticipated as being a typical connector provided on the manifold to operatively connect the manifold with the bulk fuel gas supply. An appropriately sized opening 204 (FIG. 6) may be provided in the sidewall 116 for the connection between the manifold and the bulk fuel gas supply. Because the convenience outlet is designed to receive gas from the bulk fuel tank, the convenience outlet is capable of receiving gas at the higher pressure of about 10 psi of the storage tank pressure regulator and does not have to be connected downstream of the low pressure (about ½ psi) regulator employed with a building fuel system. The convenience outlet for an LPG system can therefore be connected to the LPG gas lines on the outside of the building, as shown in FIG. 9.

The valve 300 is also located in the interior of the case 100 and is operatively connected with the manifold 200. The valve provides convenient manual on and off control of a flow of the fuel gas at a location where a gas appliance is being used. Any of variously available gas tight or otherwise appropriate shutoff valves for fuel gas supplies may be used. More specifically, the inventor has found an inline gas shutoff ball valve that has opposing quarter inch (about 6.3 mm) male and female national pipe thread (MNPT and FNPT, respectively) couplings to be suitable for this purpose.

Figure 5:
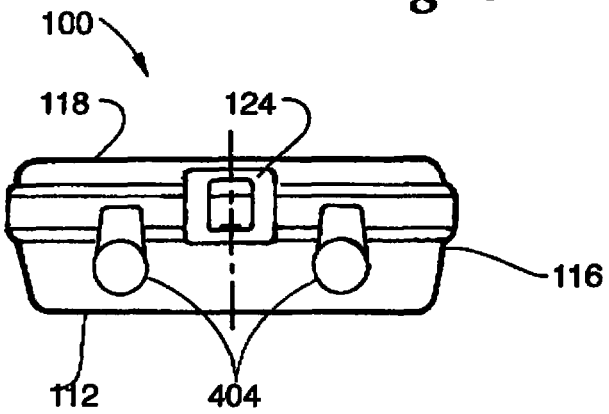
FIG. 5 is an outlet side elevation thereof.

The appliance connection 400 is operatively connected with the valve 300 and located so as to extend outside the interior of the case. Thus, suitably sized apertures 404 (FIG. 5) are provided in the sidewall 116, so the connection may extend through the sidewall. The appliance connection 400 is adapted to releasably couple in gas tight engagement a conventional appliance end fitting for with the gas supply of a gas fired appliance. In keeping with contemporary standards, the appliance connection is provided as a male threaded connection with an outside 1 5/16 inch (33.3 mm) ACME thread for screw connection coupling with a standard portable gas fueled appliance coupling as is known. A dust cap 405 releasably snaps over the open end of each connector and is attached to the neck of the connector by a flexible attachment band 407.

Further, the valve and appliance connection combine as components of a qualified Type-1 or QCC-1 valve under applicable code and regulation. Thus, a safety shutoff assembly 524 (FIG. 3) is incorporated. While a Type-1 connection is illustrated, other types of standardized connections (connections that mate with conventional appliance couplings), including threaded as well as quick connect or bayonet couplings, may be used in the present invention.

Figure 3:
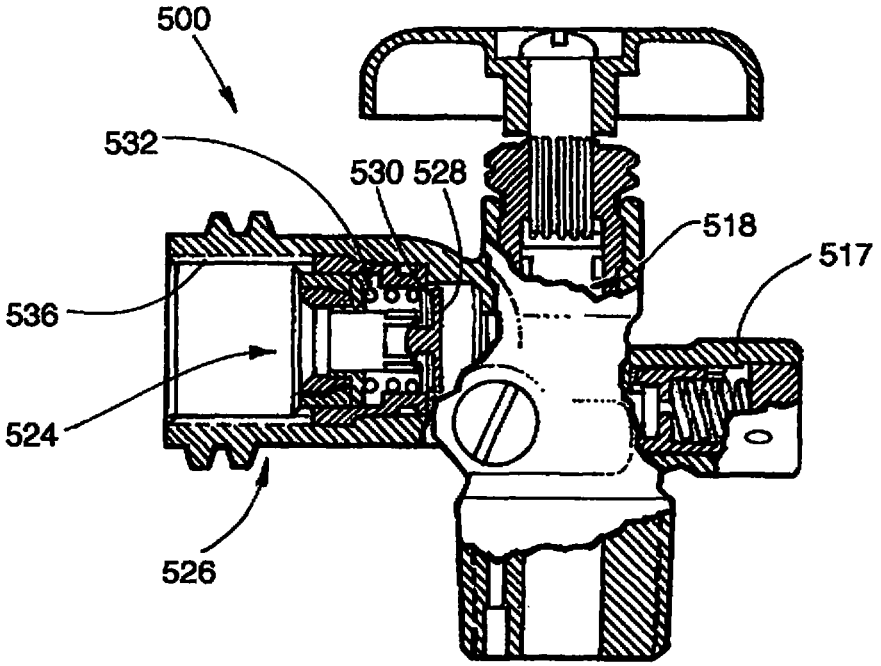
FIG. 3 is a fragmentary side elevation view of a known Type-1 ACME valve.
Figure 4:
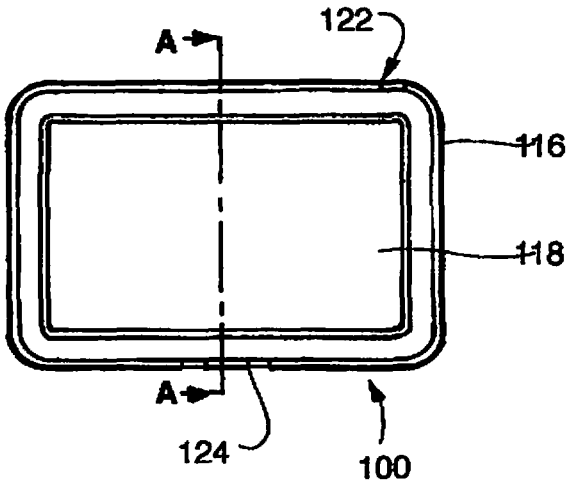
FIG. 4 is a front elevation of the case, showing the door closed.

A known Type-1 LPG tank valve 500 is shown in FIG. 3 as an example of the incorporated safety shutoff assembly. A valve of this type is shown and discussed, for example in U.S. Pat. No. 6,895,952, which patent is incorporated by reference. As shown, the valve assembly may include a pressure relief valve 517. The known valve 500 is shown with a manual shutoff valve 518 versus the valve 300 of the invention.

More specifically as to automatic shutoff valve 524, it is mounted inside an annular collar 526 that is defined by the appliance outlet 400. The automatic shutoff valve is conventional and typically includes a movable valve member 528 that is biased outwardly toward a closed position against valve seat 530 by means of a spring 532. Valve member 528 is resiliently movable inward in order to open the automatic shutoff valve 524. This occurs automatically whenever an appliance end fitting is properly attached to the valve assembly outlet, with a protruding nose on the end fitting engaging and opening the shutoff valve as the end fitting is attached to the outlet. This prevents release of fuel gas from the bulk supply by opening the valve 300 unless a gas fueled appliance and its appliance end fitting are properly connected to the gas convenience outlet appliance outlet 400. It is further noted that the collar 526 of the appliance outlet 400 may be internally threaded with a left hand pipe thread 536 to accommodate an older style Prest-O-Lite (POL) fitting, in which the appliance fitting is a male fitting that is threaded into the appliance outlet, with the appliance outlet being a female fitting in this instance.

Figure 2:
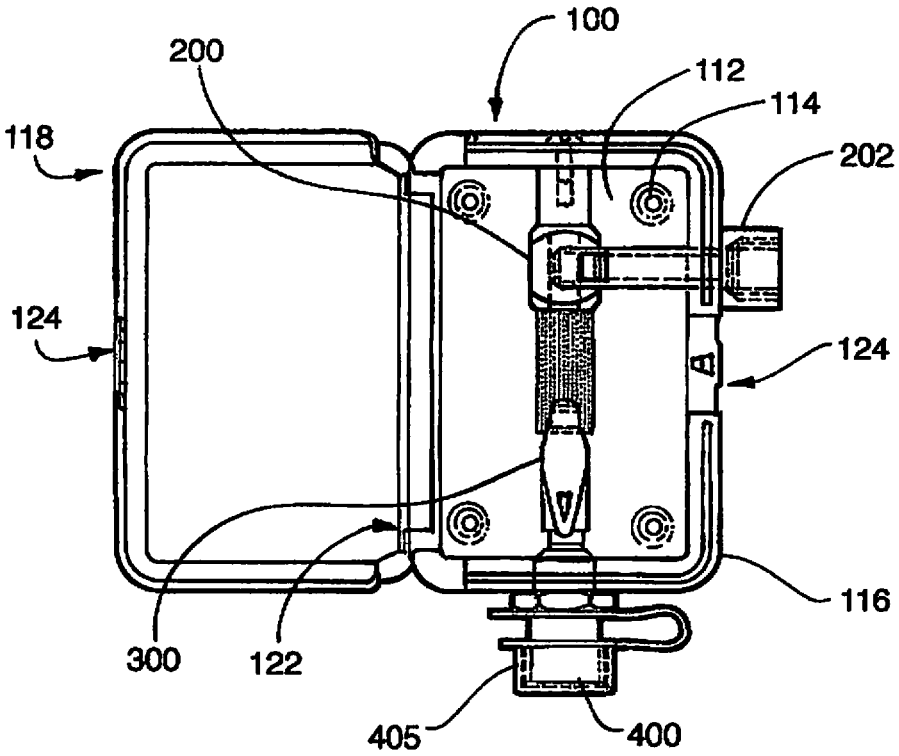
FIG. 2 is a front elevation of an alternative single gas convenience outlet configuration thereof.

As shown in FIG. 1, the outlet assembly can include two or more outlets, so that more than one appliance, such as a grill and a gas heater, can be connected and operated at the same time. By using contemporary connectors for the outlet box, the same appliance connectors used for propane fittings can be employed, and the resulting fittings will have all of the integral safety features that are present in contemporary fittings used for propane tanks.

One way in which the convenience outlet of the present invention can be connected to a typical LPG fuel supply tank 201 is shown for exemplary purposes in FIG. 9. Tank 201 generally is located outside a building 11. Tank 201 includes a tank pressure regulator 203 at the tank that reduces the tank pressure to a high pressure of about 10 psi, the LPG being conveyed to the building 11 by a supply line 204. The gas pressure is thereafter lowered to a low pressure of about ½ psi at the building by a building appliance pressure regulator 205, where the low pressure gas is carried by appliance supply line 206 and fuels a furnace 207 or other indoor gas fired appliance.

The convenience outlet is mounted on the outside of the building 11 and is connected to the LPG tank so that it receives higher pressure gas from the tank regulator 203 through conduit 213 to connected supply line 204. The outdoor grill 13 or appliance is equipped with a hose 15 and pressure regulator 17 for connection to a portable propane tank. The grill 13 is connected to the convenience outlet 10 at appliance connection 400, in the same manner as it is attached to a portable propane tank, without modification of the connector and without removal of the appliance pressure regulator 17. When a higher performance appliance is used, the fuel is therefore available at a sufficiently high pressure and flow rate to effectively supply the appliance.

A connection employed for a natural gas system is shown in phantom in FIG. 9. Natural gas supply 209 provides gas to the house at about 2 psi through supply line 215. This pressure is reduced at the entrance to the house by a pressure regulator 211, which reduces the pressure in appliance supply line 216 to around ½ psi. The convenience outlet 10 is connected by conduit 217 into the natural gas supply line 215 at a position upstream of the regulator 211, thus providing natural gas to the convenience outlet 10 at about 2 psi.

One having ordinary skill in the art and those who practice the invention will understand from this disclosure that various modifications and improvements may be made without departing from the spirit of the disclosed inventive concept. One will also understand that various relational terms, including left, right, front, back, top, and bottom, for example, are used in the detailed description of the invention and in the claims only to convey relative positioning of various elements of the claimed invention.

The invention claimed is:

1. An outdoor appliance connection system, comprising:

a fuel gas supply providing a high pressure fuel gas to a structure, the high pressure fuel gas being connected to the structure through a building pressure regulator reducing the high pressure of the fuel gas to a lower operating pressure outside of the structure, the fuel gas at the lower operating pressure entering the structure through a low pressure fuel supply line;

a convenience outlet box mounted on an exterior of the structure, the box containing a gas convenience outlet for an exterior appliance, the gas convenience outlet connectable in a sealed fashion to a conventional supply connector for an exterior appliance, the gas convenience outlet being fluidly connected to the high pressure fuel gas of the fuel gas supply upstream of the building pressure regulator.

2. The system of claim 1, wherein the fuel gas supply provides natural gas to the building pressure regulator at a supply pressure of 2 psi.

3. The system of claim 1, wherein the fuel gas supply provides liquid petroleum gas to the building pressure regulator at a supply pressure of 10 psi.

4. The system of claim 1, wherein the gas convenience outlet further comprises an inline gas shut-off valve.

5. The system of claim 4, wherein the inline gas shut-off valve include an automatic heat-actuated gas shut-off valve.

6. The system of claim 1, wherein the gas convenience outlet further comprises a manifold enclosed within the convenience outlet box, the manifold supplying multiple outlet valves each fluidly connecting the fuel gas supply through the manifold to individual connectors configured to connect a respective exterior appliance.

7. The system of claim 1, wherein the gas convenience outlet further comprises a pressure relief valve.

8. In a residential building having a building fuel gas supply comprising one of a natural gas supply and a liquefied petroleum gas (LPG) supply, wherein the pressure of the building fuel gas supply is reduced by a building pressure regulator at a building entrance to an operating gas pressure compatible with building appliances, the improvement comprising:

an auxiliary appliance connection accessible on the exterior of the building, having an inlet connected into the building fuel gas supply at a point upstream of the building pressure regulator and having an outlet that is connected to an inlet for an auxiliary appliance, and an auxiliary appliance valve regulator reducing the line pressure of the building fuel gas supply to the operating pressure of the auxiliary appliance without being affected by the building pressure regulator.

9. The system as in claim 8, wherein the building fuel gas supply comprises a natural gas supply and the auxiliary appliance valve regulator reduces the pressure of the natural gas supply from 2 PSI to ½ PSI, and the auxiliary appliance connection further includes a connection fitting compatible with a conventional inlet fitting on a gas grill.

10. The system as in claim 8, wherein the building fuel gas supply comprises a liquefied petroleum gas (LPG) supply and the auxiliary appliance valve regulator reduces the pressure of the liquefied petroleum gas supply from 10 PSI to ½ PSI, and the auxiliary appliance connection further includes a connection fitting compatible with a conventional inlet fitting on a gas grill.

11. An outdoor appliance connection system, comprising:

a liquefied petroleum gas (LPG) high pressure supply line providing a high pressure LPG to a structure, the high pressure supply line being connected to a building pressure regulator reducing the pressure of the LPG to a lower operating pressure before it enters the structure, the LPG at the lower operating pressure entering the structure through a low pressure supply line;

an outdoor appliance supply line fluidly connected to the high pressure supply line upstream of the building pressure regulator;

a convenience outlet box mounted on an exterior of the structure, the box comprising a gas convenience outlet for an exterior appliance, the gas convenience outlet being fluidly connected to the outdoor appliance supply line, and the gas convenience outlet being connectable in a sealed fashion to a conventional supply connector for an exterior appliance having a built-in pressure-reducing regulator.

* * * * *